US006996031B1

(12) United States Patent
Cripe

(10) Patent No.: US 6,996,031 B1
(45) Date of Patent: Feb. 7, 2006

(54) MIRROR WITH DIGITAL CLOCK READOUT

(76) Inventor: Jeffery L. Cripe, 306 Pratt Rd., Kalamazoo, MI (US) 49001

( * ) Notice: Subject to any disclaimer, the term of this patent is extended or adjusted under 35 U.S.C. 154(b) by 252 days.

(21) Appl. No.: 10/392,754

(22) Filed: Mar. 20, 2003

(51) Int. Cl.
*G04B 47/00* (2006.01)
*G04B 25/00* (2006.01)
*G04C 19/00* (2006.01)

(52) U.S. Cl. ..... 368/10; 368/82; 368/223

(58) Field of Classification Search ..... 368/82, 368/10, 223, 239, 278
See application file for complete search history.

(56) References Cited

U.S. PATENT DOCUMENTS

| | | | | | |
|---|---|---|---|---|---|
| 1,909,362 | A | * | 5/1933 | Keith | 40/606.03 |
| 2,132,476 | A | * | 10/1938 | En Holm | 40/219 |
| 2,586,641 | A | * | 2/1952 | Gabrielsen | 40/474 |
| 4,202,607 | A | * | 5/1980 | Washizuka et al. | 349/113 |
| 4,588,267 | A | * | 5/1986 | Pastore | 359/636 |
| 4,630,904 | A | * | 12/1986 | Pastore | 359/636 |
| RE32,576 | E | * | 1/1988 | Pastore | 359/636 |
| 4,747,086 | A | * | 5/1988 | Shaw | 368/239 |
| 4,988,140 | A | * | 1/1991 | Van Order | 362/492 |
| 5,199,009 | A | * | 3/1993 | Svast | 368/240 |
| 5,481,409 | A | * | 1/1996 | Roberts | 359/839 |
| 5,956,181 | A | * | 9/1999 | Lin | 359/630 |
| 6,167,000 | A | * | 12/2000 | Chow | 368/107 |

* cited by examiner

*Primary Examiner*—Vit W. Miska

(57) ABSTRACT

A typical mirror combined with digital clock for reading time while simultaneously looking in the mirror. To attain this, the clock, which is mounted behind the mirror, has a plurality of display devices for reading hours and minutes aligned with apertures in the black template and reflective surface of the mirror. These display devices can be light emitting diodes, liquid crystal devices, electro-luminescent displays, illuminated apertures, or other type display technology. The digital clock can be powered either by battery or from a 110-volt power source. As a product, the combinational mirror and clock can be decorative to brighten up a room. The digital clock display can have various appearances depending on the placement of the hour and minute display devices. In addition to the numeric clock display devices, an alphanumeric device can also be added for displaying various messages. The apparatus can be used by consumers and commercial establishments in a multitude of colors, shapes, styles, patterns, sizes, and designs. In a preferred embodiment, the one-to-twelve hour digits are placed in vertical lines along each edge of the mirror with the zero-to-fifty nine minutes being readout in a two-digit window placed conveniently on the face of the mirror. In an alternative embodiment the one-to-twelve hour digits are placed in a more standard circular clock arrangement with the sixty minutes being displayed in a circular arrangement of backlighted segments located just inside the hour digits, which are sequentially enabled to indicate minutes.

18 Claims, 5 Drawing Sheets

MIRROR WITH DIGITAL CLOCK READOUT

BACKGROUND OF THE INVENTION

1. Field of the Invention

The present invention relates to a mirror with built-in digital clock readout for use as both a functional and decorative device in the home and/or business. The mirror with built-in time readout has particular utility in simultaneously providing the time of day while looking in the mirror.

2. Description of the Prior Art

There are occasions when knowing the time while looking in a mirror is important. For example, when shaving or putting on makeup in preparation for keeping a scheduled event, it is important to know the time. In general, people look in the mirror every day and check the time several times every day. In many cases it would be convenient to perform these tasks simultaneously.

The use of time devices in combination with mirrors is known in the prior art. For example, U.S. Pat. No. 4,588,267 to Pastore discloses a combination rear view mirror and digital clock. However, the Pastore '267 patent is different in structure from that of the present invention, which is primarily intended as both a functional and attractive device for use in the home or business.

Similarly, U.S. Pat. No. 4,202,607 to Washizuka et al. discloses a mirror with information display that adds a time element to a mirror, which in one embodiment uses a reflective liquid crystal display device so that when the clock is turned off the clock area reflects as a normal mirror. However, the Washizuka '607 patent is different in structure from that of the present invention.

Also, U.S. Pat. No. 2,132,476 to Holm discloses a combination mirror and conventional motor driven analog clock with rotating hour and minute hands. However, the Holm '476 patent is different in structure from the present invention, which has a digital clock and no moving parts.

Lastly, U.S. Pat. No. 1,909,362 to Keith, U.S. Pat. No. 4,988,140 to Van Order, D423,944 to Chan, and D404,032 to Lee disclose apparatus that may be of general interest and pertinent to the construction and design of the present invention. The Keith '362 patent discloses a combination rear view mirror and memorandum device. The Van Order '140 patent discloses a visor with an electrically controlled vanity mirror cover for providing light in low illumination environments. Finally, the Chan '944 patent discloses the design for a clock and Lee '032 patent discloses the design of a clock radio with liquid crystal display. However, none of these patents disclosures have the structure of the present invention.

While the above-described devices fulfill their respective, particular objectives and requirements, the aforementioned patents do not describe a mirror with built-in digital clock readout for use as both a functional and decorative device in the home and/or business.

Therefore, a need exists for a new and improved mirror with built-in digital clock readout that can be used simultaneously as both a mirror and clock. The combination mirror and clock can be further used as an attractive item of display in the home or business. In this respect, the mirror with built-in digital clock readout according to the present invention substantially departs from the conventional concepts and designs of the prior art, and in doing so provides an apparatus primarily developed for the purpose of simultaneously providing the functions of a mirror and a clock.

SUMMARY OF THE INVENTION

In view of the foregoing disadvantages inherent in the known types of mirrors and clock combinations now present in the prior art, the present invention provides an improved mirror with digital clock readout, and overcomes the above-mentioned disadvantages and drawbacks of the prior art. As such, the general purpose of the present invention, which will be described subsequently in greater detail, is to provide a new and improved mirror with digital clock readout that has all the advantages of the prior art mentioned heretofore and many novel features that result in a mirror and clock combination device that is not anticipated, rendered obvious, suggested, or even implied by the prior art, either alone or in any combination thereof.

The mirror with digital clock readout of the present invention is comprised of a typical wall mirror combined with digital clock for reading time. To attain this, the clock, which is mounted behind the mirror, has a plurality of display devices for reading hours and minutes, aligned with apertures in a black template and reflective surface of the mirror. These display devices can be light emitting diodes, liquid crystal devices, electro-luminescent displays, illuminated apertures, or other type display technology. This combinational apparatus will allow a person to look in the mirror and determine the time simultaneously.

The digital clock can be powered either by battery or from a 110-volt power source. As a product, the combinational mirror and clock can be decorative to brighten up a room. The digital clock display can have various appearances depending on the placement of the hour and minute display devices. In addition to the numeric clock display devices, alphanumeric devices can also be added for displaying various messages. The apparatus can be used by consumers and commercial establishments in a multitude of colors, shapes, styles, patterns, sizes, and designs.

In a first example, the one-to-twelve hour digits are placed in vertical lines along each edge of the mirror with the zero-to-sixty minutes being readout in a two-digit window placed conveniently on the face of the mirror.

Secondly, the one-to-twelve hour digits are placed in a more standard circular clock arrangement with the zero-to-sixty minutes still being readout in a two-digit window placed conveniently on the face of the mirror.

Thirdly, the one-to-twelve hour digits are placed in a more standard circular clock arrangement with the sixty minutes being displayed in a circular arrangement of backlighted segments (apertures) located just inside the hour digits, thereby looking much like a familiar clock.

There has thus been outlined, rather broadly, the more important features of the invention in order that the detailed description thereof that follows may be better understood and in order that the present contribution to the art may be better appreciated.

There are, of course, additional features of the invention that will be described hereinafter and which will form the subject matter of the claims attached.

Numerous objects, features and advantages of the present invention will be readily apparent to those of ordinary skill in the art upon a reading of the following detailed description of presently preferred, but nonetheless illustrative, embodiments of the present invention when taken in conjunction with the accompanying drawings. In this respect, before explaining the current embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of descriptions and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved mirror with digital clock readout that provides in the apparatuses and methods of the prior art some of the advantages thereof, while simultaneously overcoming some of the disadvantages normally associated therewith.

It is another object of the present invention to provide a new and improved mirror with digital clock readout that may be easily and efficiently manufactured and marketed.

An even further object of the present invention is to provide a new and improved combination mirror and digital clock device that has a low cost of manufacture with regard to both materials and labor, and which accordingly is then susceptible of low prices of sale to the consuming public, thereby making such devices economically available to the buying public.

These together with other objects of the invention, along with the various features of novelty that characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts throughout the various figures.

DESCRIPTION OF THE PREFERRED EMBODIMENT

Figure 1:
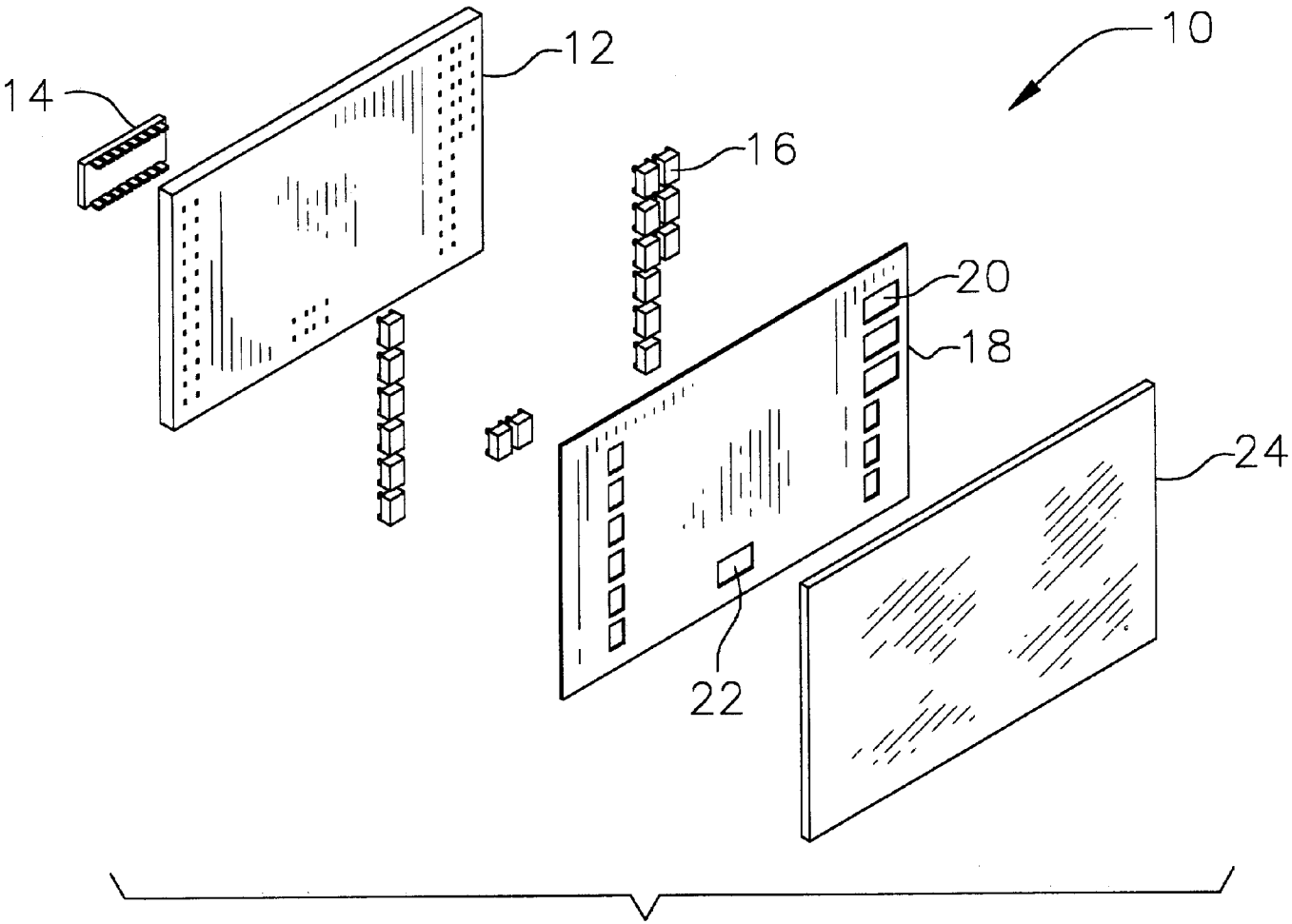
FIG. 1 is a drawing showing the build-up of the mirror assembly with digital clock readout in the preferred embodiment in accordance with the principles of the present invention.

Referring now to the drawings, and particularly to FIGS. 1–8, a preferred and second embodiment of the mirror with digital clock readout of the present invention is shown and generally designated by the reference numerals 10 and 50, respectively.

In FIG. 1, a new and improved assembly for the mirror with digital clock readout 10 of the present invention is illustrated and will be described. More particularly, the assembly 10 has a two-sided printed circuit board 12 with control and driver integrated circuits 14 mounted on the backside and digital display devices 16 mounted on the front side. A black template 18, which is the size of the mirror 24 and having apertures 20,22 (small windows) cut to align with the display devices 16, is aligned and attached to the back side (side with reflective film) of the two-way mirror 24. This template 18 provides, with its apertures being mounted to the two-way mirror on the reflective film side, an exposed surface for the digital reading out of alphanumeric digits and numbers. A circuit board 12, with matching displays 16 aligned with the template/mirror apertures, completes the assembly. Any number of digital display chips can be used to implement the clock, including light emitting diodes, liquid crystal devices, electro-luminescent displays, and illuminated apertures.

Figure 2:
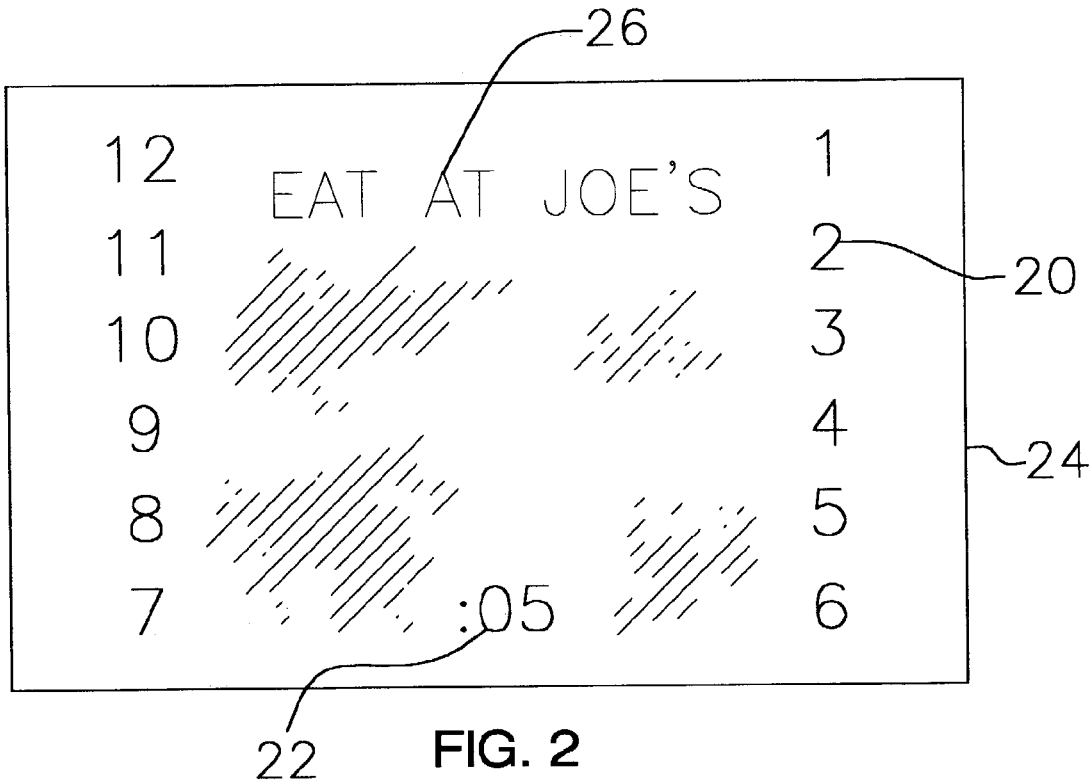
FIG. 2 is a front view of the combination mirror and digital display for one configuration of the preferred embodiment of the present invention.

FIG. 2 is a front view of the combination mirror and digital display for one version of the preferred embodiment of the present invention. In this embodiment, the hour digits 20 are arranged in two vertical columns along the sides of the mirror 24. This requires at least nine single-digit display chips for the numerals 1–9 and three double-digit display chips for the numerals 10–12. Minute digits 22 are readout in a separate window conveniently located on the mirror 24 surface. Minutes readout will require at least a double-digit display chip for the numerals 0–59, and a three-digit display if a colon (:) is included. Also, a multi-character alphanumeric display 26 can be included for displaying messages or other signage. Optionally, messages, advertisements, graphical images could be painted on the surface of the mirror.

Figure 3:
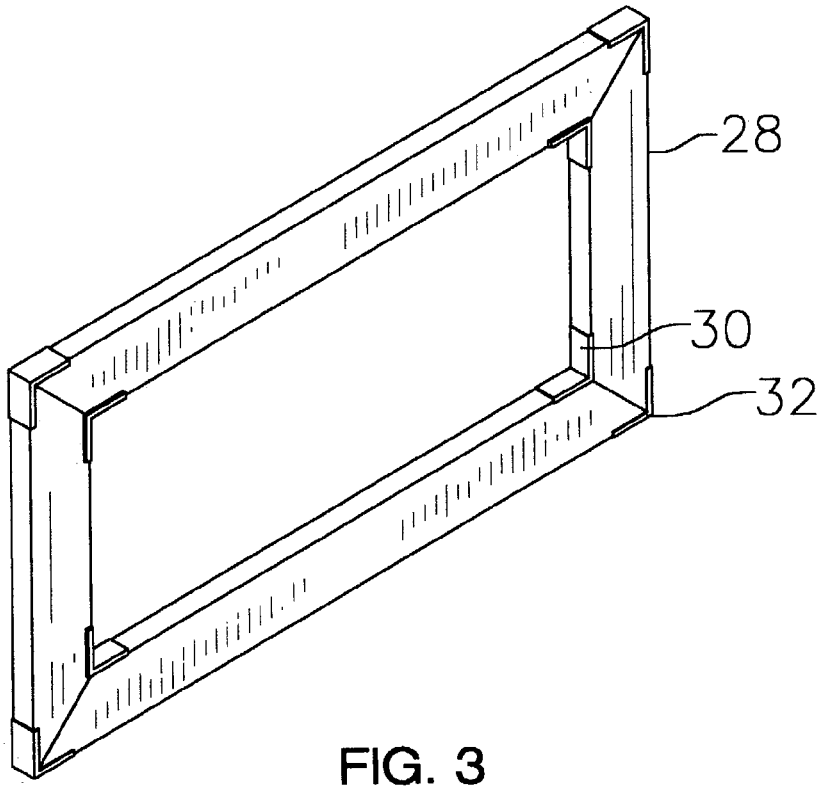
FIG. 3 is a perspective view of an alternative picture frame-like printed circuit board for use in the combination mirror and digital display of the present invention.

FIG. 3 is a perspective view of an alternative picture frame-like circuit board 28 for use in the combination mirror and digital display of the present invention. Here, the circuit board 28 only covers the area where the display chips are located. This printed circuit board arrangement would work well with the embodiment of FIG. 2, since all the display readouts are located on the perimeter of the mirror. In this case, smaller circuits boards could be used and connected at the corners by inside 30 and outside 32 bracket means, assuming that the assembly cost are less the reduced circuit board cost.

Figure 4:
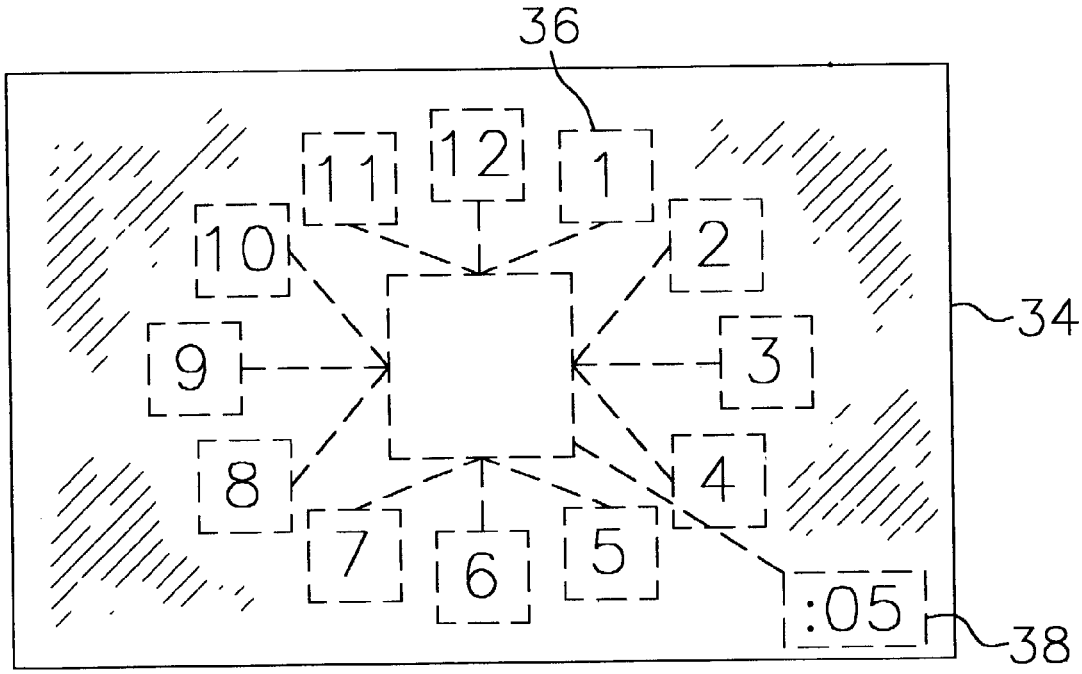
FIG. 4 is a drawing showing a second build-up of the mirror assembly with digital clock readout in the preferred embodiment in accordance with the principles of the present invention using multiple, small printed circuit boards.

FIG. 4 is a drawing showing a second build-up of the mirror assembly with digital clock readout in the preferred embodiment in accordance with the principles of the present invention using multiple, smaller printed circuit boards. Here, at least thirteen small display chip circuit boards 36,38, along with a somewhat larger control circuit board 40 are mounted behind the mirror 34 to provide the digital clock.

Figure 5:
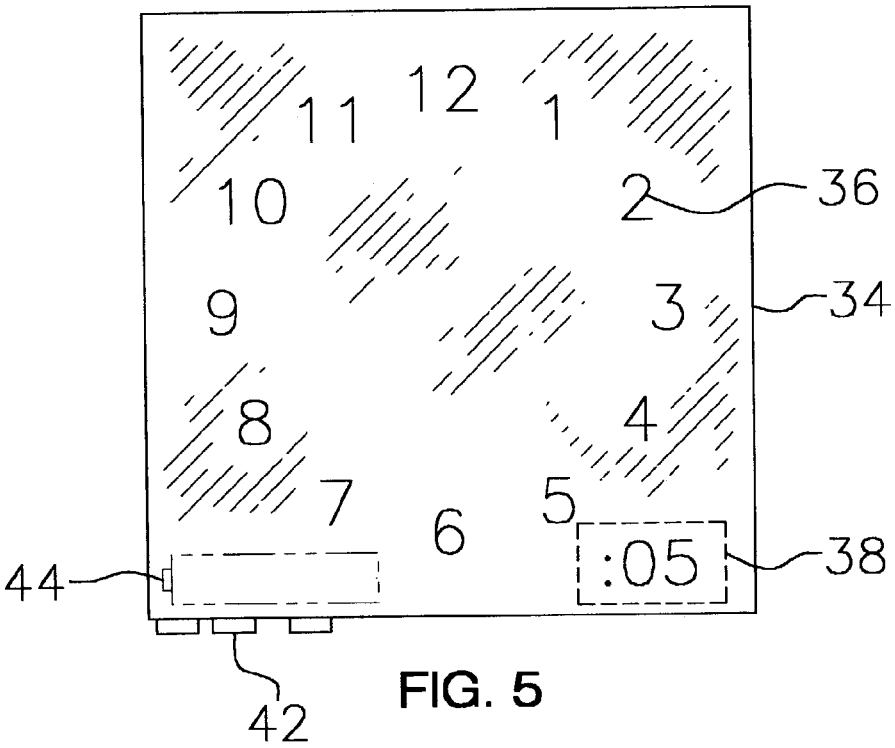
FIG. 5 is a front view of the combination mirror and digital display of FIG. 4.

FIG. 5 is a front view of the combination mirror and digital display of FIG. 4. In the case the hour digits 36 are arranged in a more-or-less standard circular clock configuration and the minutes are readout sequentially from 0–59 in a separate window 38. Control buttons 42 (switches) are used to set the clock time and/or modes. The digital clock is powered by means of a battery 44 or an optional DC power supply that plugs into a 110-volt outlet.

Figure 6:
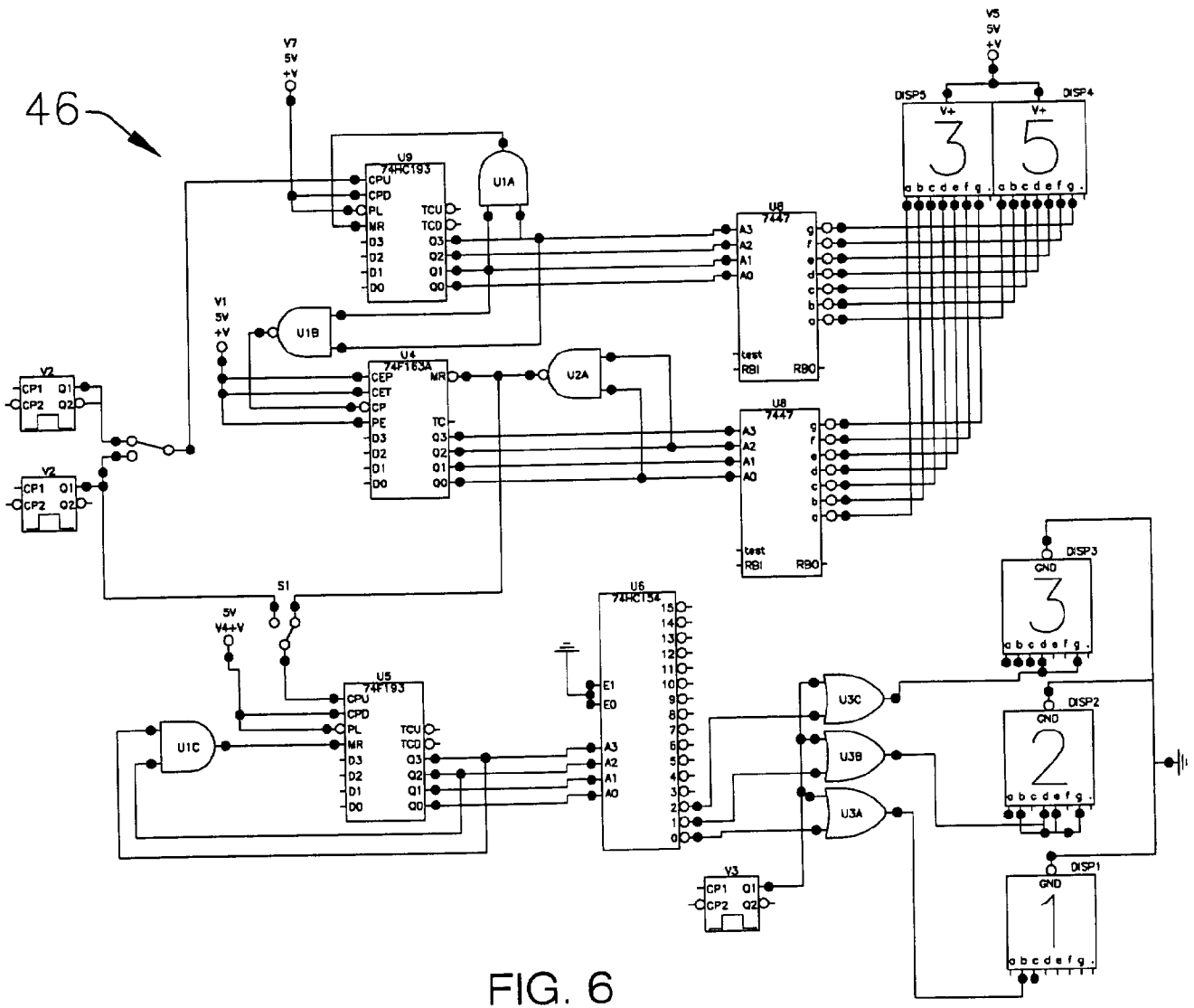
FIG. 6 is a schematic diagram showing one example of an electronic circuit for controlling the digital clock in the preferred embodiment of the present invention.

FIG. 6 is an example showing a schematic diagram 46 of an electronic circuit for controlling the digital clock in the preferred embodiment of the present invention. This is just one of many circuits that can be used with the clock. The circuitry can be fabricated using any number of available or custom integrated circuits, for example programmable logic arrays, microprocessors, display drivers, and applications specific integrated circuits.

Figure 7:
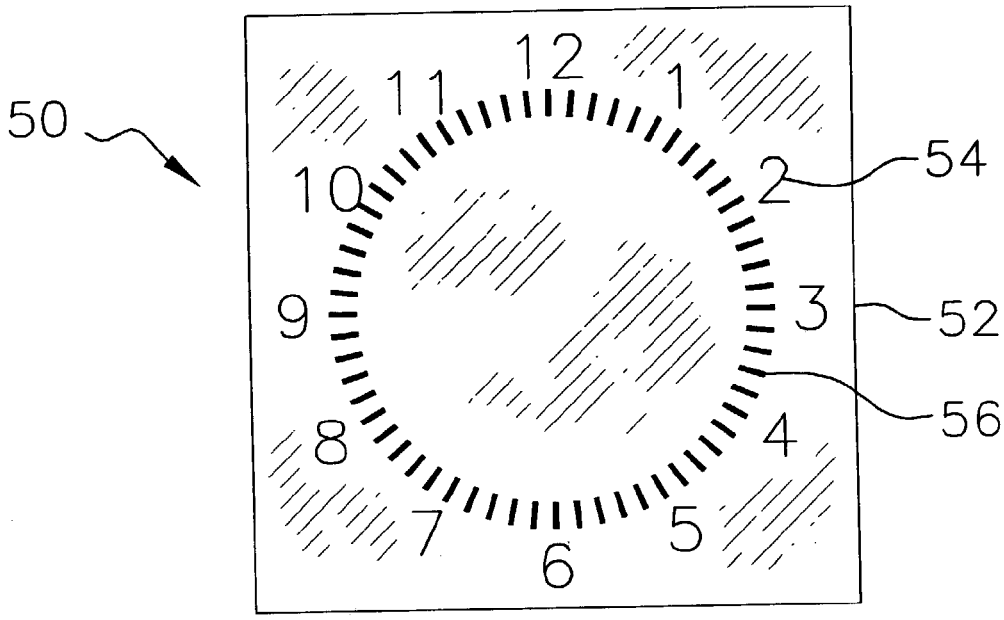
FIG. 7 is a front view of a combination mirror and digital display for a second embodiment of the present invention where minute readout segments are sequentially lighted.

FIG. 7 is a front view of a combination mirror and digital display for a second embodiment 50 of the present invention where minutes are readout by sequentially back lighting a series of segments. Here, the hour digits 54 are arranged in a circular standard clock-like configuration on the surface of the mirror 52. In use of telling-time, all numbers 54 are lit with one of them being deferent from the others to signify that this is the designated hour of time. However, the minute digits 56 are arranged circularly just inside the hour digits 54, also in a standard clock-like configuration. In this case, while one of the hour digits 54 indicates the hour, the minute segments 56 sequentially indicate the minute within the displayed hour, thereby providing a display that can quickly be read.

Figure 8:
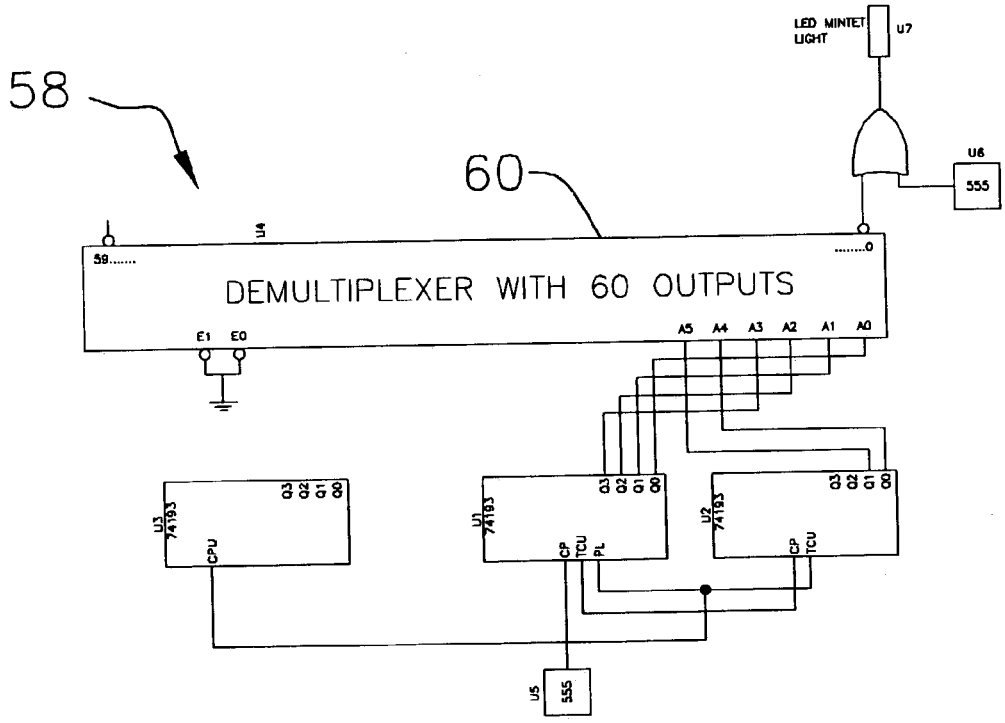
FIG. 8 is a schematic diagram showing one example of a 60-output demultiplexer circuit used to sequentially drive minute light segments in the second embodiment of the present invention described in FIG. 7.

Finally, FIG. 8 is a schematic diagram 58 showing one example of a 60-output demultiplexer circuit 60 used to sequentially drive the minute light segments in the second embodiment of the present invention described in FIG. 7. This circuit might typically be provided as an application specific integrated circuit (ASIC).

While a preferred and second embodiment of the mirror with digital clock has been described in detail, it should be apparent that modifications and variations thereto are possible, all of which fall within the true spirit and scope of the invention. With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention. For example, various numbers and types of display chips can be used to provide the digital readout. Also, the display chips can be arranged in various configurations to provide many unique clocks embedded in a mirror.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed is:

1. A digital clock in combination with a mirror, comprising:

a digital clock, said clock further comprised of:

one or more circuit boards;

one or more control integrated circuit chips mounted on the backside of said circuit board for controlling said clock;

a plurality of numeric display devices arranged on the front side of at least one of said circuit boards in a format for displaying hours;

one or more numeric display devices arranged on the front side of at least one of said circuit boards in a format for displaying minutes, said numeric display devices on at least one of said circuit boards comprising:

at least nine single-digit numeric display devices arranged on said circuit board for reading hours one through nine;

at least three double-digit numeric display devices arranged on said circuit board for reading hours ten through twelve; and at least one double-digit numeric display device arranged on said circuit board for reading minutes zero through sixty;

a black template mounted in front of at least one of said circuit boards by attaching means, said black template having a plurality of template apertures aligned to match said display devices on said front side of at least one of said circuit boards;

two or more control buttons attached to at least one of said circuit boards for setting said digital clock;

a low-voltage DC power supply for providing power to at least one of said circuit boards; and a mirror mounted in front of said black template by attaching means, the reflective surface of said mirror having a plurality of mirror apertures aligned with said black template apertures for viewing the digits of said display devices.

2. The apparatus of claim 1, wherein said apparatus has at least one alphanumeric display for displaying messages.

3. The apparatus of claim 1, wherein said apparatus includes signage on the surface of said apparatus.

4. The apparatus of claim 1, wherein said power supply is selected from the group consisting of a battery and a DC power supply being sourced from 110-volt AC.

5. The apparatus of claim 1, wherein said display devices are attached to said circuit board such as to readout around the perimeter of said mirror, said circuit board having a picture-frame shape.

6. The apparatus of claim 1, wherein said display devices are attached to small individual circuit boards, said control integrated circuit chips further installed on a small individual control circuit board.

7. The apparatus of claim 1, wherein said display devices are of the group comprised of: light emitting diodes, liquid crystal devices, electro-luminescent displays, and illuminated apertures.

8. The apparatus of claim 1, wherein said integrated circuit chips are from the grouped comprised of: programmable logic arrays, microprocessors, display drivers, and applications specific integrated circuits.

9. A digital clock in combination with a mirror, comprising:

a digital clock, said clock further comprised of:

a circuit board;

one or more control integrated circuit chips mounted on the backside of said circuit board for controlling said clock;

twelve numeric display devices arranged on the front side of said circuit board in a clock-like circular format for displaying hours;

sixty back-lighted light segment means circularly arranged on the front side of said circuit board inside said numeric display devices for indicating minutes;

a black template mounted in front of said circuit board by attaching means, said black template having a plurality of template apertures aligned to match said display and light segment devices on said front side of said circuit board;

two or more control buttons attached to said circuit board for setting said digital clock;

a low-voltage DC power supply for providing power to said circuit board, said power supply being sourced from 110-volt AC; and a mirror mounted in front of said black template by attaching means, the reflective surface of said mirror having a plurality of mirror apertures aligned with said black template apertures for viewing the digits of said display devices and said light segments.

10. The apparatus of claim 9, said numeric display devices on said circuit board comprising:

at least nine single-digit numeric display devices suitably arranged on said circuit board for reading hours one through nine; and at least three double-digit numeric display devices suitably arranged on said circuit board for reading hours ten through twelve.

11. The apparatus of claim 9, wherein said apparatus has at least one alphanumeric display for displaying messages.

12. The apparatus of claim 9, wherein said apparatus includes signage on the surface of said apparatus.

13. The apparatus of claim 9, wherein said apparatus is battery powered.

14. The apparatus of claim 9, wherein said display devices are of the group comprised of: light emitting diodes, liquid crystal devices, electro-luminescent displays, and illuminated apertures.

15. The apparatus of claim 9, wherein said integrated circuit chips are from the grouped comprised of:

programmable logic arrays, microprocessors, display drivers, and applications specific integrated circuits.

16. The apparatus of claim 9, wherein a sixty-output demultiplexer circuit is used to drive said sixty backlighted light segment means.

17. A digital clock in combination with a signage board, comprising:

a digital clock, said clock further comprised of:

a circuit board;

one or more control integrated circuit chips mounted on said circuit board for controlling said clock;

a plurality of numeric display devices mounted on said circuit board for displaying hour and minute display digits, said display devices on said circuit board comprising:

at least nine single-digit numeric display devices arranged on said circuit board for reading hours one through nine;

at least three double-digit numeric display devices arranged on said circuit board for reading hours ten through twelve; and at least one double-digit numeric display device arranged on said circuit board for reading minutes zero through sixty;

a black template mounted in front said circuit board by attaching means, said black template having a plurality of template apertures aligned to match said display devices on said circuit board;

two or more control buttons attached to said circuit board for setting said digital clock;

a power supply for running said clock; and a front signage board mounted in front of said black template by attaching means.

18. The assembly of claim 17, wherein said front signage board is a mirror mounted in front of said black template by attaching means, the reflective surface of said mirror having a plurality of mirror apertures aligned with said black template apertures for viewing said display digits from the front of said mirror.

* * * * *